US006027356A

United States Patent [19]

Wright

[11] Patent Number: 6,027,356

[45] Date of Patent: Feb. 22, 2000

[54] CONNECTOR ASSEMBLY

[75] Inventor: John O. Wright, York, Pa.

[73] Assignee: Osram Sylvania Inc., Danvers, Mass.

[21] Appl. No.: 09/313,791

[22] Filed: May 18, 1999

[51] Int. Cl.[7] ..... H01R 11/12

[52] U.S. Cl. ..... 439/268; 439/859

[58] Field of Search ..... 439/266, 268, 439/858, 859, 909

[56] References Cited

U.S. PATENT DOCUMENTS

| | | | |
|---|---|---|---|
| 4,094,571 | 6/1978 | Benjamin | 439/859 |
| 5,037,335 | 8/1991 | Campell | 439/859 |
| 5,897,406 | 4/1999 | Benes et al. | 439/859 |

*Primary Examiner*—Hien Vu
*Attorney, Agent, or Firm*—William H. McNeill

[57] ABSTRACT

A female connector assembly that includes mating housings which may be latched together to enclose a female connector having resilient opposed curved arms and a resilient dome-shaped actuator disposed between such arms. Depression of the dome causes its lower edge to move radially outwardly to engage the inner surface of the arms to move such arms radially outwardly. Release of the dome allows the dome and resilient arms to resile to their original position. In use, the female connector assembly may be electrically and mechanically connected to a male connector to form a connector assembly. To this end, the male connector is inserted between the resilient arms of the female connector. Such insertion cams the arms radially outward until they are adjacent a recess in the male connector and snap radially inward against the male connector. To disconnect the connectors, the arms are caused to move radially outward by depression of the dome.

21 Claims, 5 Drawing Sheets

CONNECTOR ASSEMBLY

TECHNICAL FIELD

The present invention relates to a connector assembly, which includes a female connector, and a mating male connector that may be electrically and mechanically connected together. The present invention particularly relates to such a connector assembly useful in connection with an antenna embedded within a window of an automobile wherein a pin-like male connector coupled to the antenna and extending from a surface of the window is connected to a right-angle female connector coupled to an antenna cable.

BACKGROUND ART

The connector assembly of the present invention is illustrated herein with reference to an antenna. However, it will be apparent to those skilled in the art that the connector assembly of the present invention is not limited to such an application.

The use of a radio antenna positioned within a window of an automobile is well known. One of the concerns regarding such an antenna is the integrity of the electrical and mechanical connection provided by the connector assembly located between the antenna and the antenna cable coupled to the radio system. Efforts to tighten up on such connections provides mating connectors that are difficult to couple together and to uncouple. However, it is desired that the male and female connectors be readily connected and disconnected, as desired. In some prior art devices the lack of satisfactory tactile feedback makes it difficult to know when a suitable connection has been made. In addition, providing a satisfactory ground may present a concern in some applications. In addition, the presence of a connector assembly between the antenna and the antenna cable, and within view of the vehicle user, tends to be unsightly, and therefore a compact connector assembly is desired.

DISCLOSURE OF THE INVENTION

It is an object of the present invention to provide an improved connector assembly.

Another object of the present invention is to obviate the disadvantages of the prior art by providing an improved connector assembly.

Yet another object of the present invention is to provide an improved connector assembly for electrically and mechanically connecting an antenna embedded in a window to an antenna cable.

A further object of the present invention is to provide a connector assembly that provides the required electrical and mechanical connection between male and female connectors and yet may be readily connected and disconnected.

It is still another object of the present invention to provide a connector assembly that provides tactile feed-back.

Another object of the present invention is to provide a connector assembly that provides improved grounding.

A further object of the present invention is to provide a connector assembly that is compact.

Yet another object of the present invention is to provide a female connector assembly which achieves all of the foregoing objects.

Another object of the present invention is to provide a right angle female contact which achieves all of the foregoing objects.

This invention achieves these and other objects by providing a connector assembly, comprising a male connector comprising an engagement surface, and a female connector. The female connector comprises a first housing having a first opening therein and a second housing having a second opening therein. The second housing is structured and arranged to mate with the first housing such that the first opening is in alignment with the second opening. A resilient female connector is provided having a third opening therein and structured and arranged for mating with the first housing such that the third opening is in alignment with the first opening. A resilient actuator is provided which is structured and arranged (a) for insertion into the third opening, (b) for urging the female connector away from the engagement surface when the actuator is depressed in a first mode, and (c) for permitting the female connector to resile into engagement with the engagement surface when the actuator is released in a second mode.

BRIEF DESCRIPTION OF THE DRAWINGS

This invention may be clearly understood by reference to the attached drawings in which like reference numerals designate like parts and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
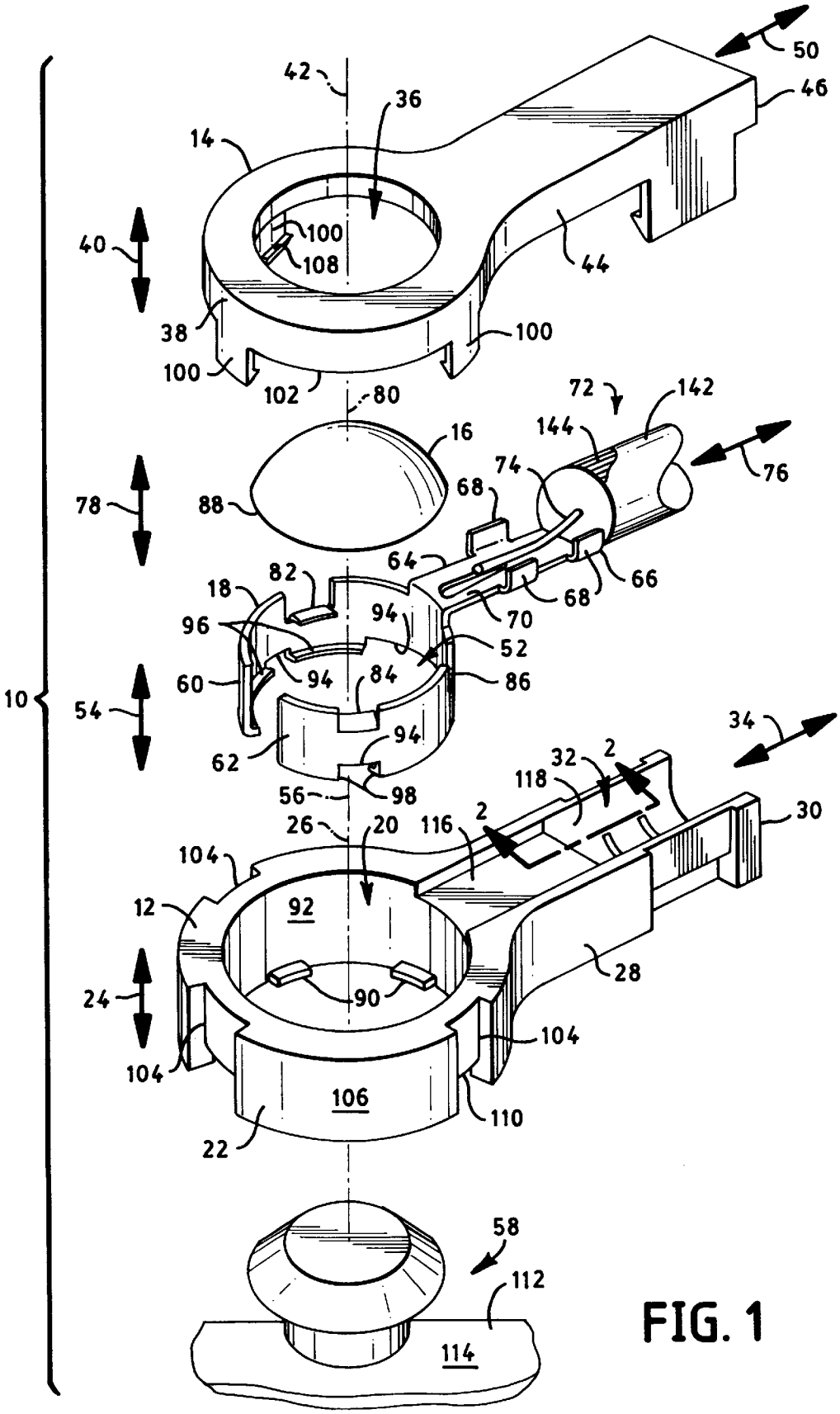
FIG. 1 is an exploded view of one embodiment of the connector assembly of the present invention.

Referring to the drawings, FIG. 1 illustrates a connector assembly 10 in accordance with one embodiment of the present invention. The connector assembly 10 comprises a female connector assembly comprising a first housing 12, second housing 14, resilient actuator 16 and resilient female connector 18.

The first housing of the present invention includes an opening therein. For example, in the embodiment illustrated in FIG. 1, housing 12 includes an opening 20. Without limitation, opening 20 is circular in configuration and extends through a cylindrical portion 22 of the housing. Opening 20 extends in direction 24 of an axis 26. Housing 12 includes a leg 28 that extends from the cylindrical portion 22 to a distal leg end 30. The leg 28 includes a channel 32 that extends from the opening 20 to the distal leg end 30. Channel 32 extends in a direction 34 radially from axis 26.

Figure 2:
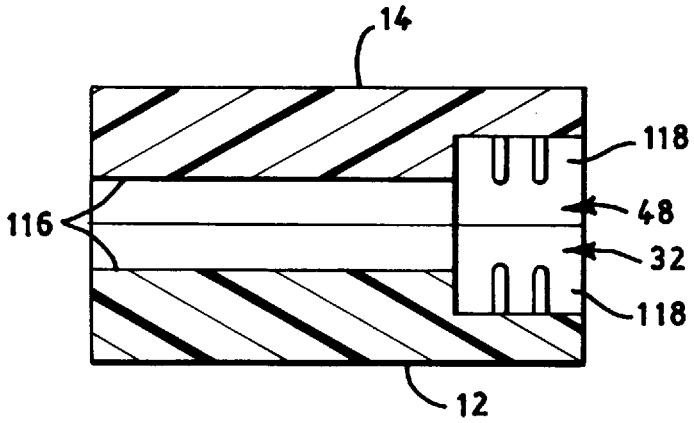
FIG. 2 is a sectional view of FIG. 1 taken along lines 2—2.

The second housing of the present invention includes an opening therein. For example, in the embodiment illustrated in FIG. 1, housing 14 includes an opening 36. Without limitation, opening 36 is circular in configuration and extends through a cylindrical portion 38 of the housing. Opening 36 extends in direction 40 of an axis 42. With reference to FIGS. 1 and 2, housing 14 includes a leg 44 that extends from the cylindrical portion 38 to a distal leg end 46. The leg 44 includes a channel 48 that extends from the opening 36 to the distal leg end 46. Channel 48 extends in a direction 50 radially from axis 42. Although not necessary, channel 48 is identical to channel 32. The housing 14 is structured and arranged to mate with the housing 12 as described herein such that the opening 20 is in alignment with the opening 36 and the channels 32 and 48 together form a conductor enclosure as illustrated in FIG. 2.

The resilient female connector of the present invention includes an opening therein. For example, in the embodiment illustrated in FIG. 1, connector 18 includes an opening 52. The opening 52 has a generally circular configuration and extends in a direction 54 of an axis 56. The connector 18 is structured and arranged for mating with the housing 12 such that the opening 52 is in alignment with opening 20. In use, a male connector 58 will extend into openings 20 and 52, as described herein. Without limitation, the connector 18 comprises resilient opposing curved arms 60 and 62. When the connector assembly 10 is assembled as described herein, the arms 60 and 62 will reside within, and be concentric with, opening 20.

The female connector 18 includes a leg 64 that extends from the arms 60 and 62 to a distal leg end 66. Leg 64 includes tabs 68. Tabs 68 may be crimped towards surface 70 to electrically and mechanically connect a conductor 72 to the connector 18. For example, in the embodiment illustrated in FIG. 1, the tabs 68 may be crimped towards surface 70 to engage the central monofilament wire 74 of a coaxial cable-type conductor 72. The leg 64 extends in a direction 76 radially from axis 56. Leg 64 is structured and arranged to extend in the conductor enclosure formed by the opposing channels 32 and 48, as described herein.

The resilient actuator of the present invention includes an actuator axis and is structured and arranged for insertion into the opening in the resilient female connector. The resilient actuator is also structured and arranged to urge the female connector away from the actuator axis when the actuator is depressed in a first mode and to permit the female connector to resile towards the actuator axis when the actuator is released in a second mode. Without limitation, in the embodiment illustrated in FIG. 1, the resilient actuator 16 is in the form of a resilient dome having a hemispherical configuration and extending in the direction 78 of an axis 80. The resilient dome 16 is structured and arranged for insertion into the opening 52 of the resilient female connector 18. The resilient actuator 16 may be fabricated from, for example, metal or plastic.

The resilient female connector of the present invention may comprise at least one support member that extends into the opening of the female connector and is structured and arranged to provide a fixed support for the resilient actuator within such opening. For example, in the embodiment illustrated in FIG. 1, the resilient female connector 18 comprises one support member 82 extending into the opening 52 from arm 60 and two support members 84 and 86 extending into the opening 52 from arm 62. The support members 82, 84 and 86 extend into opening 52 towards axis 56 a sufficient distance to provide support for the dome 16 when it is inserted into the opening 52. To this end, the edge 88 of the dome 16 will rest upon the support members 82, 84 and 86 when inserted into opening 52.

The first housing of the present invention may comprise at least one support member which extends into the opening of the first housing and is structured and arranged to support the resilient female connector within such opening. For example, in the embodiment illustrated in FIG. 1, the housing 12 comprises a plurality of support members 90 (only two are visible) which extend into the opening 20 from an inner surface 92 of the cylindrical portion 22. The support members 90 extend into opening 20 towards axis 26 a sufficient distance to provide support for the resilient female connector 18 when it is inserted into the opening 20. To this end, the recessed edge segments 94 of the connector 18 will rest upon respective support members 90 when inserted into opening 20.

The resilient female connector of the present invention may comprise at least one abutment member which extends into the opening of the female connector and is structured and arranged (a) for disengagement from the male connector when the actuator member is depressed in the first mode, and (b) for biased engagement with the male connector when the actuator member is released in the second mode, as described hereinafter. For example, in the embodiment illustrated in FIG. 1, the resilient connector 18 comprises two abutment members 96 which extend into the opening 52 from the arm 60 and two abutment members 98 which extend into the opening 52 from arm 62. The abutment members 96 and 98 extend into opening 52 towards axis 56 a sufficient distance (a) to radially engage the male connector 58 in the second mode, and (b) to radially disengage the male connector in the first mode to permit removal of the female connector 18 from the male connector, as described hereinafter. It will be noted that the edge segments 94 are positioned between respective abutment members 96 and 98 as illustrated in FIG. 1. In such configuration, when the support members 90 engage a respective edge segment 94, the support members 90 will not interfere with the radial movement of the abutment members 96 and 98.

The female connector assembly of the present invention may be held together in any manner desired. For example, and without limitation, the housings 12 and 14 may be force fit together or held together by screws or an adhesive. In the embodiment illustrated in FIG. 1, a latching mechanism is provided. In particular, the housing 14 includes a plurality of resilient latches in the form of legs 100 that extend in direction 40 from the edge 102 of the cylindrical portion 38. Housing 12 includes a plurality of mating latches in the form of grooves 104 that extend in direction 24 in the surface 106 of the cylindrical portion 22. The legs 100 include abutment surfaces 108 and the mating grooves include mating abutment surfaces 110. When the housings 12 and 14 are united, the resilient legs 100 snap into place relative to respective grooves 104 such that the surfaces 108 engage respective mating surfaces 110 to hold the housings together.

Use of the connector assembly of the present invention will now be described in connection with a conventional automobile radio antenna of the type embedded within a window. Such use is by way of example only, the connector assembly of the present invention having many other applications.

With reference to FIG. 1, an automobile window 112 includes an antenna therein (not shown) electrically connected to the male connector 58 in a conventional manner. Male connector 58 is attached to the outer surface 114 of the window 112 in a conventional manner, as for example, by an adhesive. To prepare the female connector assembly for connection to the male connector the coaxial cable 72 is first electrically and mechanically connected to the female connector 18 as described herein by crimping the tabs 68 towards surface 70 until they firmly engage the central monofilament wire 74 of the cable. The wire 74 may be connected to the female connector 18 by soldering or welding the wire to surface 70, or in any other manner which effects a satisfactory electrical and mechanical connection.

The female connector 18 is then inserted into the housing 12. In particular, the opposing curved arms 60, 62 are inserted into the opening 20 until the edge segments 94 of the arms engage respective supports 90. If desired, the channel 32 may comprise a flat surface 116 upon which the leg 64 may rest and an arcuate surface 118 upon which the cable 72 may rest. Channel 48 of the housing 14 may have similar flat and arcuate surfaces. The arms 60, 62 are structured and arranged so as to be spaced from the inner surface 92 sufficiently to allow for the radial outward flexing of the arms, and the corresponding radially outward movement of the abutment members 96, 98, as described herein. The resilient dome 16 is then inserted into the opening 52 until the edge 88 rests upon the respective supports 82, 84 and 86.

Figure 3:
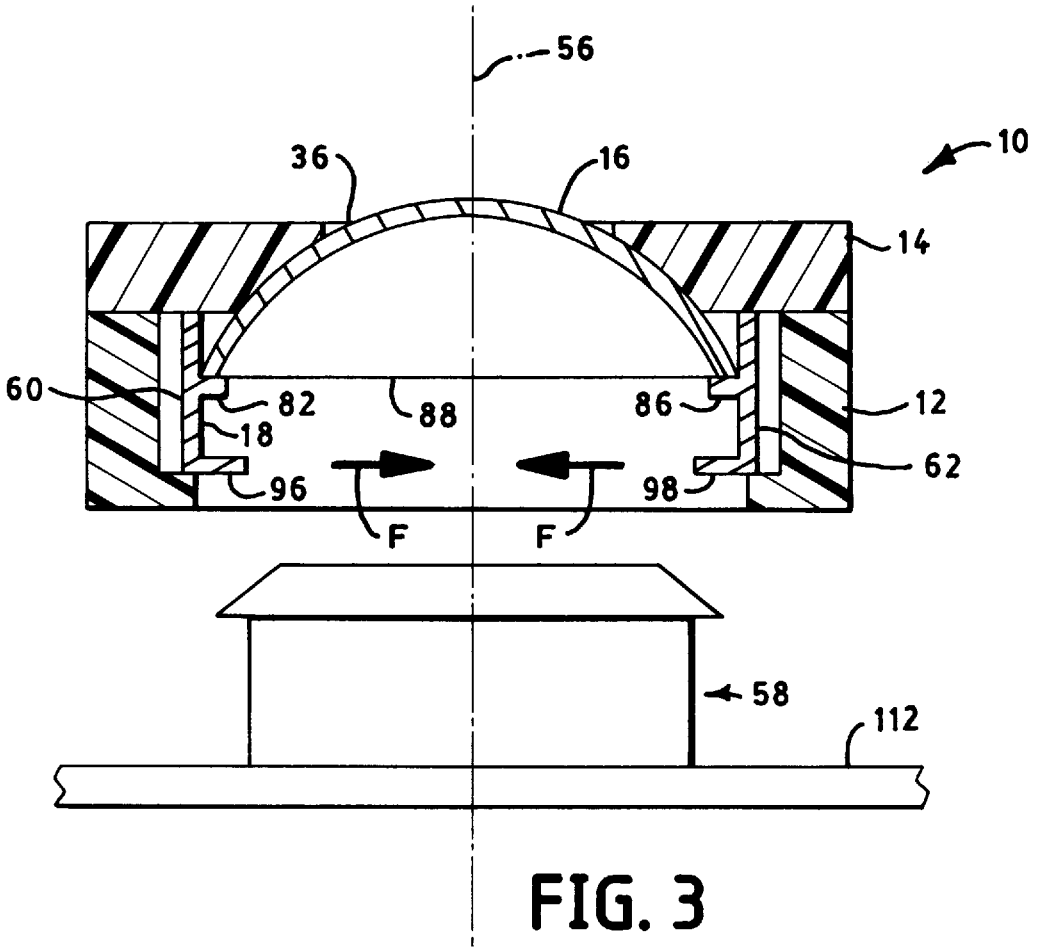
FIG. 3 is a diagrammatic representation of the female connector assembly of FIG. 1 about to be connected to the male connector of FIG. 1.

In order to complete the assembly, the housing 14 is mated with the housing 12 thereby enclosing the resilient dome 16 and the resilient female connector 18. In particular, legs 100 of the housing 14 are aligned with respective grooves 104 of the housing 12, and the housings are urged together until the engagement surfaces 108 snap into place relative to the mating engagement surfaces 110 to provide a compact female connector 18. When assembled in this manner, the leg 64 of the female connector 18, and the end of the cable 72, will be located within the conductor enclosure formed by channels 32 and 48. The arcuate surfaces 118 may comprise projections that bite into the cable cover to resist pull-out forces exerted upon the cable 72. When the connector 10 has been assembled, the axes 26, 42, 56 and 80 will be coincident. When the female connector assembly has been assembled in this manner, the resilient dome will protrude through the opening 36, and the resilient opposing curved arms 60, 62 will be biased, and exert a force F, towards the axis 56. To this extent the actuator dome will be in the second mode as illustrated in FIG. 3.

Figure 4:
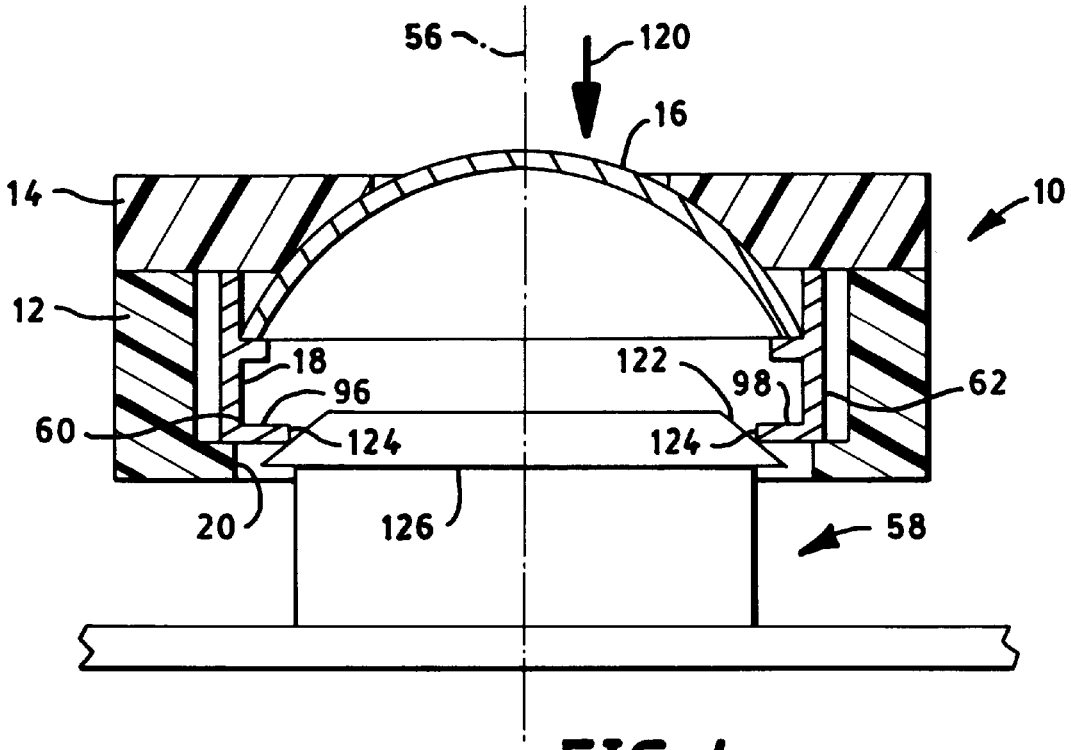
FIG. 4 is a diagrammatic representation of the female connector assembly and male connector of FIG. 1 being connected together without depressing an actuator member.

With reference to FIG. 4, when it is desired to connect the female connector 18 to the male connector 58, the female connector is urged in direction 120 towards the male connector 58 such that the male connector enters the opening 20 of housing 12 and engages the abutment surfaces 96, 98 of the resilient female connector 18. The male connector 58 may include a bevelled camming surface 122 which is structured and arranged to engage the edges 124 of the abutment members 96, 98 to thereby cam the resilient opposing curved arms 60 and 62 away from axis 56 thereby expanding the arms. The arms 60 and 62 will continue to expand until the abutment members 96, 98 are below the surface 126 of the male connector 58, as illustrated in FIG. 5.

Figure 5:
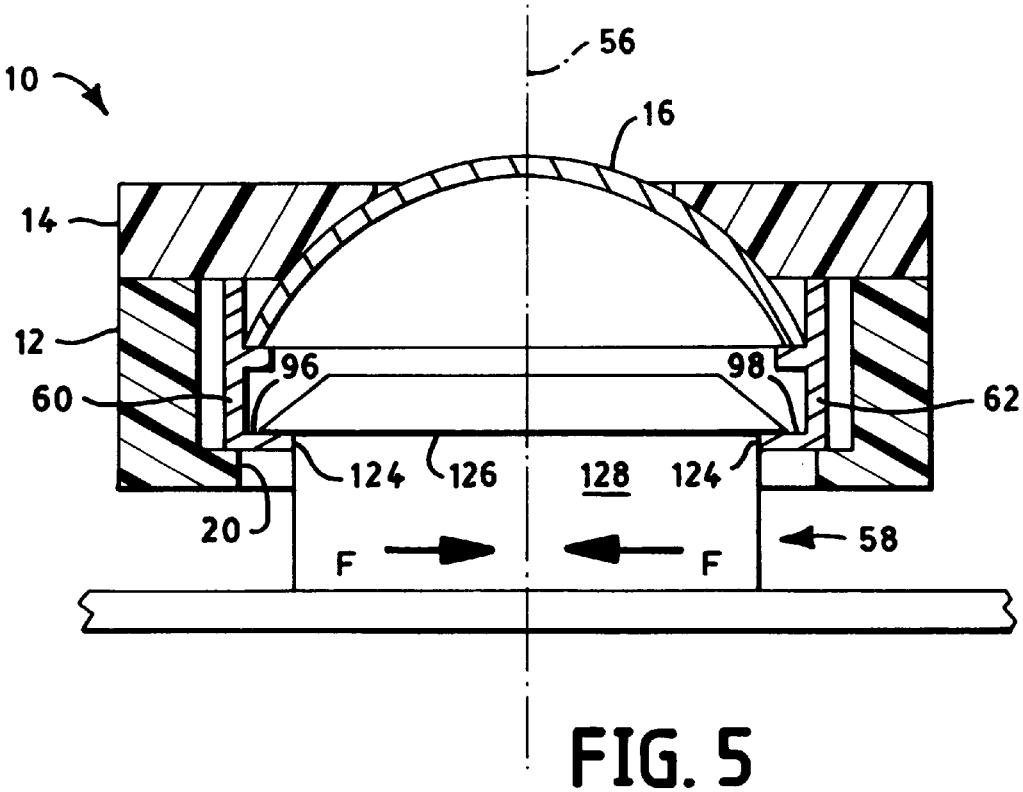
FIG. 5 is a diagrammatic representation of the female connector assembly and male connector of FIG. 1 fully connected.

With reference to FIG. 5, when the abutment members 96, 98 are below surface 126, the resilient arms 60, 62 resile towards axis 56 to latch the female connector 18 to the male connector 58. It should be noted that the abutment members 96, 98 of the resilient arms 60 and 62 are structured and arranged so that the abutment members will be biased, and exert force F, against the surface 128 of the male connector 58 sufficiently to effect electrical and mechanical connection with surface 128 when the arms resile towards axis 56. In the embodiment illustrated in the drawings, the abutment members 96, 98 extend at a right angle from the inner surface of the arms 60 and 62, the edges 124 being curved to conform to and engage the cylindrical surface 128 when the arms resile towards connector axis 56. Engagement of the abutment members 96, 98 with the surface 128 provides the desired tactile feedback assuring the user that electrical and mechanical connection has been effected.

Figure 6:
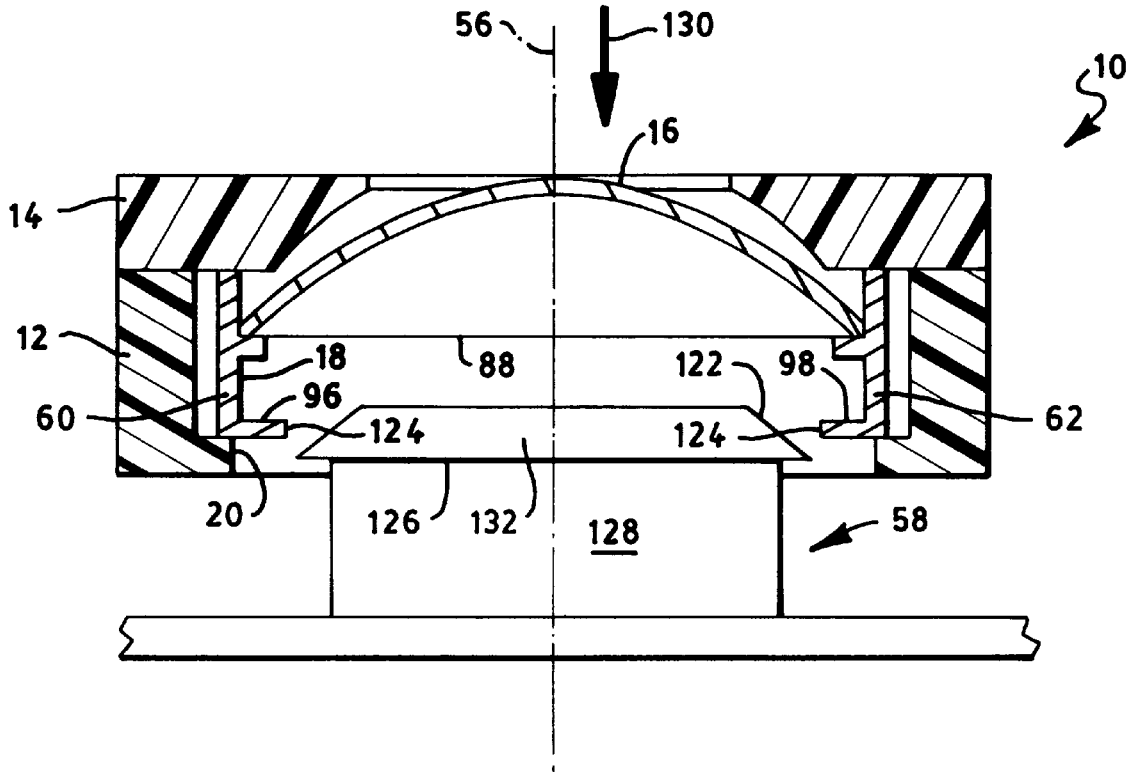
FIG. 6 is a diagrammatic representation of the female connector assembly and male connector of FIG. 1 being connected together, or disconnected, by depressing an actuator member.

If desired, the female connector assembly may be attached to the male connector 58 by depressing the dome 16 to urge the arms 60 and 62 apart. In particular, with reference to FIG. 6, by depressing the resilient dome 16 in direction 130, the dome will deflect downwardly and outwardly causing the edge 88 of the dome to move radially away from axis 56 and engage the arms 60 and 62 thereby urging the arms and abutment members 96 and 98 radially away from axis 56 sufficiently to permit the female connector 18 to be lowered upon the male connector 58. When the abutment members 96 and 98 are below the surface 126 of the male connector 58, the dome 16 is released and the edge 88 will resile towards axis 56 allowing arms 60 and 62 to resile towards axis 56 and abutment members 96 and 98 to engage surface 128 as illustrated in FIG. 5.

When it is desired to remove the female connector assembly 18 from the male connector 58, the resilient dome is depressed in direction 130 as noted above, causing the edge 88 to once again urge the arms 60 and 62 away from the surface 128 sufficiently to permit the abutment members 96, 98 to clear the head 132 of the male connector as the female connector 18 is removed therefrom.

Figure 7:
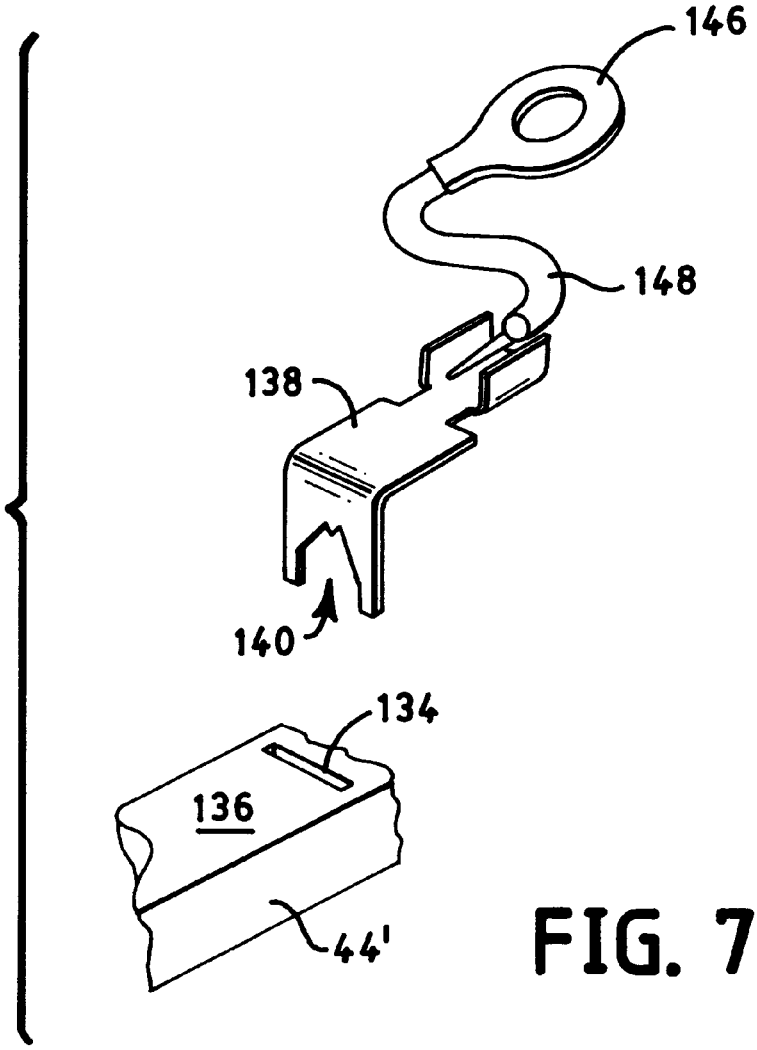
FIG. 7 is an alternative embodiment of the present invention.
Figure 8:
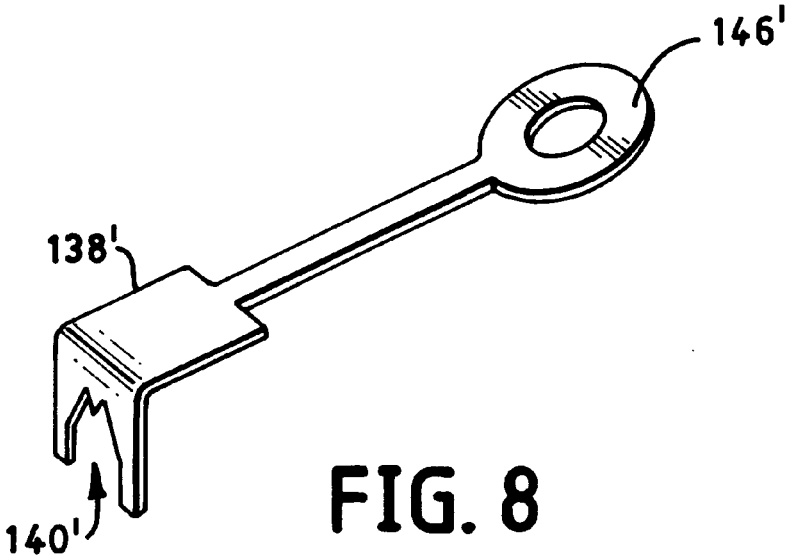
FIG. 8 is another alternative embodiment of the present invention.

The connector assembly of the present invention also includes features for grounding the cable attached thereto. For example, although not necessary, one of the legs 12, 14 may include a slot into which a conductor engaging grounding member is inserted. In the embodiment illustrated in FIG. 7, the leg 44' is identical to leg 44 of the housing 14 with the exception that a slot 134 is provided which extends from an outer leg surface 136 to channel 48. When the female conductor assembly is assembled as described herein, the slot 134 will extend from the surface 136 to the conductor enclosure formed by the mating channels 32 and 48. The slot 134 is structured and arranged for insertion of a mating conductor engaging grounding member 138. Grounding member 138 includes a surface area 140 which cuts through the plastic cover 142 of the cable 72 and engages the braid material 144. A conductor 148 connects the opposite end of the grounding member 138 to a grounding lug 146. With reference to FIG. 8, a similar grounding member 138' may be provided comprising a similar surface area 140' and a grounding lug 146' integral therewith by being formed from the same piece of material.

Fabrication of the connector assembly of the present invention may be accomplished using conventional procedures. For example, the actuator 16 (when metal), female connector 18 and grounding member 138, 138' may be stamped from a metal sheet and then rolled and/or bent as required to form the desired configuration. The housing 12, 14 and actuator 16 (when plastic) may be molded from a plastic material. The male connector 58 may be molded or machined from metal.

The embodiments which have been described herein are but some of several which utilize this invention and are set forth here by way of illustration but not of limitation. It is apparent that many other embodiments that will be readily apparent to those skilled in the art may be made without departing materially from the spirit and scope of this invention.

What is claimed is:

1. A female connector assembly suitable for connection to a male connector, comprising:

a first housing having a first opening therein;

a second housing having a second opening therein, said second housing being structured and arranged to mate with said first housing such that said first opening is in alignment with said second opening;

a resilient female connector having a third opening therein and structured and arranged for mating with said first housing such that said third opening is in alignment with said first opening; and a resilient actuator having an actuator axis and structured and arranged (a) for insertion into said third opening, (b) for urging said resilient female connector away from said actuator axis when said actuator is pressed in a first mode, and (c) for permitting said resilient female connector to resile towards said actuator axis when said actuator is released in a second mode.

2. The female connector assembly of claim 1 wherein said first housing comprises at least one first support member extending into said first opening, said at least one first support member being structured and arranged to support said resilient female connector within said first opening.

3. The female connector assembly of claim 1 wherein said resilient female connector comprises at least one second support member extending into said third opening, said at least one second support member being structured and arranged to support said actuator within said third opening.

4. The female connector assembly of claim 1 wherein said resilient female connector comprises at least one abutment member extending into said third opening, said at least one abutment member being structured and arranged for biased engagement with said male connector in said second mode and disengagement from said male connector in said first mode.

5. The female connector assembly of claim 1 wherein said first opening is circular in configuration and extends through a first cylindrical portion of said first housing, said second opening is circular in configuration and extends through a second cylindrical portion of said second housing, and said resilient female connector comprises resilient opposing curved arms which are concentric with said first opening.

6. The female connector assembly of claim 5 wherein said first housing comprises at least one first support member extending into said first opening, said at least one first support member being structured and arranged to support said resilient female connector within said first opening.

7. The female connector assembly of claim 5 wherein said resilient female connector comprises at least one second support member extending into said third opening from each arm of said opposing curved arms, said at least one second support member being structured and arranged to support said actuator within said third opening.

8. The connector assembly of claim 7 wherein said resilient female connector comprises at least one abutment member extending into said third opening, said at least one abutment member being structured and arranged for biased engagement with said male connector in said second mode and disengagement from said male connector in said first mode.

9. The female connector assembly of claim 6 wherein said resilient female connector comprises at least one abutment member extending into said third opening, said at least one abutment member being structured and arranged for biased engagement with said male connector in said second mode and disengagement from said male connector in said first mode.

10. The female connector assembly of claim 8 wherein said resilient female connector comprises at least one second support member extending into said third opening from each arm of said opposing curved arms, said at least one second support member being structured and arranged to support said actuator within said third opening.

11. The female connector assembly of claim 1 wherein said first housing comprises at least one latch and said second housing comprises at least one mating latch.

12. The female connector assembly of claim 5 wherein said first housing comprises a first leg extending from said first cylindrical portion to a distal first leg end, said first leg comprising a first channel extending from said first opening to said first leg end, and said second housing comprises a second leg extending from said second cylindrical portion to a distal second leg end, said second leg comprising a second channel extending from said second opening to said second leg end, said first and second channels structured and arranged to mate together to form a conductor enclosure.

13. The female connector assembly of claim 12 wherein said first channel extends radially from a first axis of said first opening, and said second channel extends radially from a second axis of said second opening.

14. The female connector assembly of claim 12 wherein said resilient female connector comprises a third leg extending from said opposing curved arms to a distal third leg end, said third leg being structured and arranged to extend in said conductor enclosure.

15. The female connector assembly of claim 14 wherein one of said first leg and said second leg comprises a slot which extends from an outer leg surface to said conductor enclosure and is structured and arranged for insertion of a mating conductor engaging grounding member.

16. The female connector assembly of claim 14 wherein said first housing comprises at least one latch and said second housing comprises at least one mating latch.

17. A connector assembly, comprising:

a male connector comprising an engagement surface; and a female connector assembly, comprising:

a first housing having a first opening therein;

a second housing having a second opening therein, said second housing being structured and arranged to mate with said first housing such that said first opening is in alignment with said second opening;

a resilient female connector having a third opening therein and structured and arranged for mating with said first housing such that said third opening is in alignment with said first opening; and a resilient actuator structured and arranged (a) for insertion into said third opening, (b) for urging said resilient female connector away from said engagement surface when said actuator is depressed in a first mode, and (c) for permitting said resilient female connector to resile into engagement with said engagement surface when said actuator is released in a second mode.

18. The connector assembly of claim 17 wherein said first opening is circular in configuration and extends through a first cylindrical portion of said first housing, said second opening is circular in configuration and extends through a second cylindrical portion of said second housing, and said resilient female connector comprises resilient opposing curved arms which are concentric with said first opening.

19. The connector assembly of claim 18 wherein said first housing comprises at least one first support member extending into said first opening, said at least one first support member being structured and arranged to support said female connector within said first opening.

20. The connector assembly of claim 19 wherein said resilient female connector comprises at least one second support member extending into said third opening from each arm of said opposing curved arms, said at least one second support member being structured and arranged to support said actuator within said third opening.

21. The female connector assembly of claim 20 wherein said resilient female connector comprises at least one abutment member extending into said third opening, said at least one abutment member being structured and arranged for biased engagement with said male connector in said second mode and disengagement from said male connector in said first mode.

* * * * *